US005321893A

United States Patent [19]

Engebretson

[11] Patent Number: 5,321,893

[45] Date of Patent: Jun. 21, 1994

[54] CALIBRATION CORRECTION METHOD FOR MAGNETIC SURVEY TOOLS

[75] Inventor: Harold J. Engebretson, Longbranch, Wash.

[73] Assignee: Scientific Drilling International, Houston, Tex.

[21] Appl. No.: 23,387

[22] Filed: Feb. 26, 1993

[51] Int. Cl.[5] ..... E21B 47/022

[52] U.S. Cl. ..... 33/304; 33/313

[58] Field of Search ..... 33/304, 302, 303, 312, 33/313

[56] References Cited

U.S. PATENT DOCUMENTS

| | | | |
|---|---|---|---|
| Re. 33,708 | 10/1991 | Roesler | 33/304 |
| 3,587,175 | 6/1971 | Armistead . | |
| 3,862,499 | 1/1975 | Isham et al. | 33/312 |
| 3,896,412 | 7/1975 | Rohr | 33/304 |
| 4,163,324 | 8/1979 | Russell et al. | 33/313 |
| 4,433,491 | 2/1984 | Ott et al. | 33/302 |
| 4,510,696 | 4/1985 | Roesler | 33/304 |
| 4,649,349 | 3/1987 | Chiron et al. | 33/313 |
| 4,672,752 | 6/1987 | Hulsing, II et al. | 33/312 |
| 4,682,421 | 7/1987 | van Dongen et al. | 33/302 |
| 4,709,486 | 12/1987 | Walters | 33/304 |
| 4,761,889 | 8/1988 | Cobern et al. | 33/302 |
| 4,783,742 | 11/1988 | Peters | 33/304 |
| 4,813,274 | 3/1989 | DiPersio et al. | 33/313 |
| 4,819,336 | 4/1989 | Russell | 33/304 |
| 4,956,921 | 9/1990 | Coles | 33/304 |
| 4,999,920 | 3/1991 | Russell et al. | 33/304 |
| 5,012,412 | 4/1991 | Helm | 33/302 |
| 5,155,916 | 10/1992 | Engrebretson | 33/302 |
| 5,172,480 | 12/1992 | LaBue et al. | 33/304 |

FOREIGN PATENT DOCUMENTS

| | | |
|---|---|---|
| 1259187 | 9/1989 | Canada . |
| 193230 | 9/1986 | European Pat. Off. . |
| 1240830 | 7/1971 | United Kingdom . |
| 2122751 | 1/1983 | United Kingdom . |
| 2138141 | 10/1984 | United Kingdom . |
| 2158587 | 11/1985 | United Kingdom . |
| 2185580 | 7/1987 | United Kingdom . |

*Primary Examiner*—William A. Cuchlinski, Jr.
*Assistant Examiner*—C. W. Fulton
*Attorney, Agent, or Firm*—William W. Haefliger

[57] ABSTRACT

A method for determining the orientation of the axis of a borehole with respect to an Earth-fixed reference coordinate system at a selected series of locations in the borehole, the borehole having a trajectory, and adapted to receive a drill string, comprising defining a model for the influence of magnetic interference from elements of the drill string on the measurement of components of the Earth's magnetic field in the borehole in terms of an unknown vector, a measurement vector, and a measurement matrix relating the unknown vector and the measurement vector; measuring at two or more selected locations along the borehole trajectory at least one of two cross-borehole components of the Earth's gravity field at the selected locations in the borehole, and two cross-borehole components and an along-borehole component of the Earth's gravity field at the selected locations in the borehole; two cross-borehole components and an along-borehole component of the Earth's magnetic field at the selected locations; computing the elements of the measurement vector and measurement matrix from the measured Earth's gravity and magnetic field components for the selected locations; solving for the unknown vector; computing corrected values for the Earth's magnetic field components using the unknown vector, the model, and the measured Earth's magnetic field components; and determining a value for the azimuthal orientation of the borehole axis using the corrected values for the Earth's magnetic field components and the measured gravity components.

22 Claims, 3 Drawing Sheets

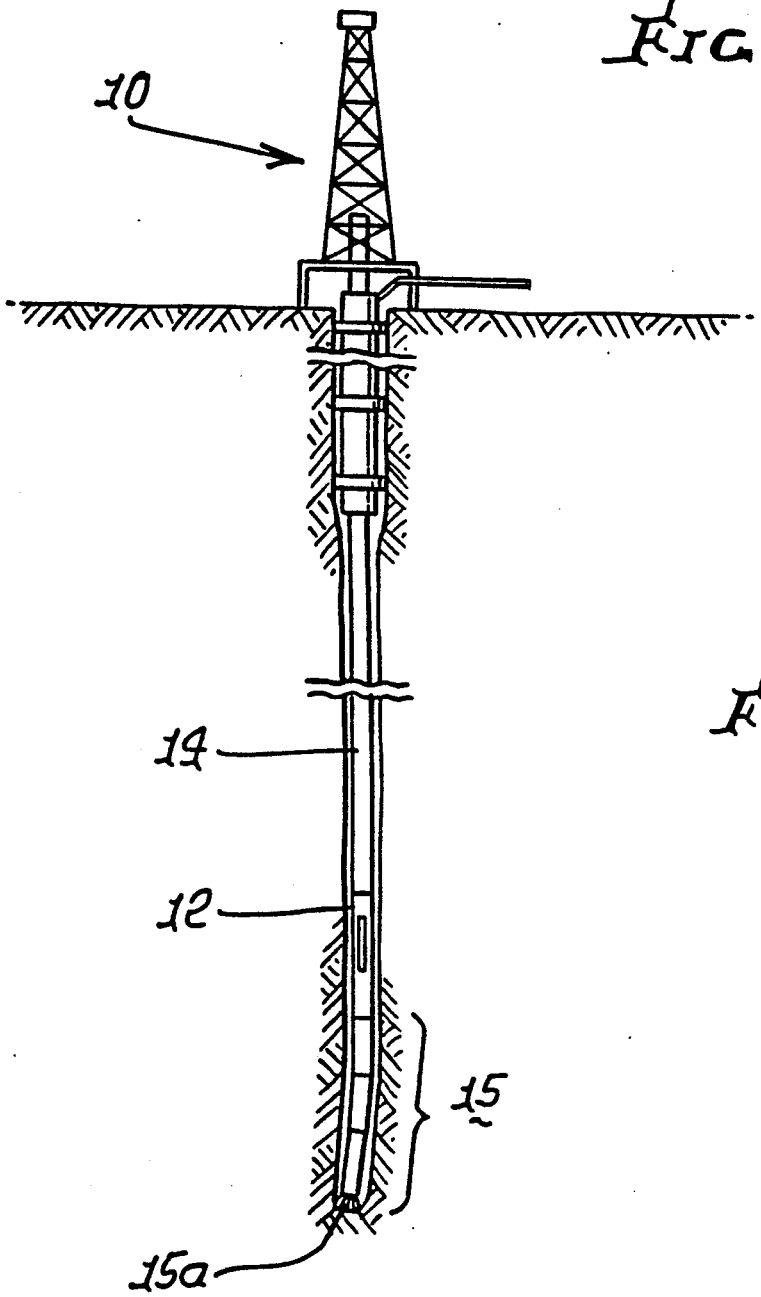
FIG. 1.
FIG. 1a.
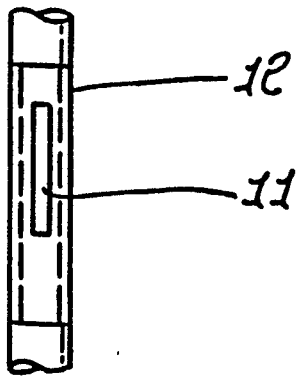

(LOOKING DOWNWARD ALONG D)

(LOOKING TOWARD THE ORIGIN FROM E)

(LOOKING DOWNWARD ALONG z)

CALIBRATION CORRECTION METHOD FOR MAGNETIC SURVEY TOOLS

BACKGROUND OF THE INVENTION

It is generally well known that magnetic survey tools are disturbed in varying ways by anomalous magnetic fields associated with fixed or induced magnetic fields in elements of the drill string. It is further well known that the predominant error component lies along the axis of the drill string. This latter fact is the basis for several patented procedures, to eliminate the along-axis field errors in 3-magnetometer survey tools. Among these are U.S. Pat. Nos:

4,163,324 to Russell et al.
4,433,491 to Ott et al.
4,510,696 to Roeslet
4,709,486 to Walters
4,682,421 to Van Dongen et al.
4,761,889 to Cobern et al.
4,819,336 to Russel
5,155,916 to Engebretson
U.K. patents 2,138,141A to Russell et al. and 2,185,580 to Russell.

Engebretson U.S. Pat. No. 5,155,916 provides a method for error reduction in compensation for magnetic interference.

All of these methods, in effect, ignore the output of the along-axis magnetometer, except perhaps for selecting a sign for a square root computation. They provide an azimuth result by computation of a synthetic solution, either:

1) by using only the two cross-axis magnetometers and known characteristics of the Earth field, or 2) by using the cross-axis components and an along-axis component computed from the cross-axis components and known characteristics of the Earth's field.

Most of these require, as the known characteristics of the Earth field, one or more of the following:

1) field magnitude
2) dip angle
3) horizontal component
4) vertical component.

The Walters method requires, as known characteristics of the Earth field, only that:

1) the field magnitude is constant in the survey area;
2) the dip angle is constant in the survey area.

The fact that these quantities are constant is all that is required. The value of the constant is not needed but is derived within the correction algorithm.

Since all of these compensation methods use, in effect, a computed along-axis component, all of them break down for cases of borehole high inclination angles in a generally East/West direction. This is because the cross-axis measurement plane for such condition tends to be aligned so as to contain both the gravity and Earth field vectors, and thus measurements in this plane provide a poor measure of the cross product of the Earth field and gravity vectors. The cross product vector of the two reference vectors is the vector that actually contains the directional reference information.

The actual degradation of accuracy at high inclinations in the East/West direction for the previously cited methods depends both on the inherent accuracy of the sensors in the survey tool and on the accuracy of the required knowledge of the Earth field characteristics.

To provide a mechanization for a magnetometer survey tool that does not seriously degrade in accuracy at borehole higher inclination angles near the East/West direction, it is found to be necessary to provide a method and means to calibrate the errors in the along-axis magnetometer so that accurate measurements can be made with it. This is in direct contrast with existing methods that substitute computed values for along-axis measurements.

There is, therefore, need to provide a calibration method for an along-axis magnetometer in a magnetic survey tool to correct anomalous magnetic effects in a drill string and thereby to permit accurate measurements of the along-axis component of the Earth magnetic field. Such accurate measurement of the along-axis component then permits accurate computation of azimuthal direction independent of inclination and direction.

SUMMARY OF THE INVENTION

The drill string anomalous magnetization is composed of both a fixed component resulting from permanently magnetized elements in the bottom hole assembly and the drill string, and an induced component resulting from the interaction of soft magnetic materials with the Earth field. The along-axis component of the induced field can be expected to be proportional to the along-axis component of the Earth field. This model of a fixed error and an along-axis induced field proportional to the true along-axis Earth field can be interpreted as simply altering the basic along-axis magnetometer's bias or offset error, and its scale factor for measuring the Earth field component.

In its simplest form, the present invention provides a method, including the steps of determining a set of along-axis magnetometer errors at different points along the borehole path by any of the well known methods, and then fitting these errors to a model, as referred to, for bias and scale factor so that accurate along-axis measurements can be computed using the determined bias and scale factor values.

In a more generalized embodiment, the invention provides a method to calibrate the effects of magnetic interference from the drill string that includes modeling the interference effects as an unknown vector that includes as elements the anomalous scale factor and bias effects; making a series of measurements at a number of different survey locations along the borehole; forming from the measurement data a measurement vector and a measurement matrix relating the measurement vector to the unknown vector; and solving the unknown vector. The elements of the unknown vector may then be used to compute accurate along-axis measurements and for quality control purposes.

These and other objects and advantages of the invention, as well as the details of an illustrative embodiment, will be more fully understood from the following specification and drawings, in which:

DRAWING DESCRIPTION

FIG. 1, shows a typical'borehole and drill string, including a magnetic survey tool;

FIG. 1*a* shows a survey tool in a drill collar, as used in FIG. 1;

FIG. 2*a* shows the influence of a piece of high permeability magnetic material when placed parallel to an originally undisturbed magnetic field;

FIG. 2*b* shows the influence of a piece of high permeability magnetic material when placed perpendicular to an originally undisturbed magnetic field; and FIGS. 3*a*, 3*b*, 3*c*, and 3*d* show a coordinate set in relation to a borehole and an Earth-fixed coordinate set.

DETAILED DESCRIPTION

Figure 2A:
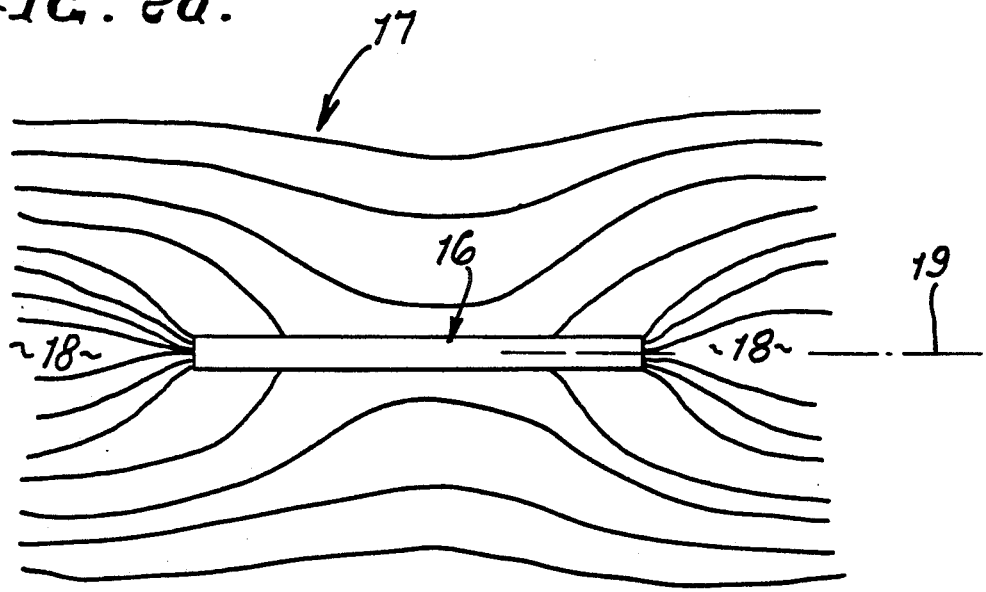

FIG. 1 shows a typical drilling rig 10 and borehole 13 in section. A magnetic survey tool 11 is shown contained in a non-magnetic drill collar 12 (made, for example, of Monel or other non-magnetic material) extending in line along the borehole 13 and the drill string 14. The magnetic survey tool is generally of the type described in Isham et al. U.S. Pat. No. 3,862,499, incorporated herein by reference. It contains three nominally orthogonal magnetometers and three nominally orthogonal accelerometers for sensing components of the Earth's magnetic and gravity fields. The drill string 14 above the non-magnetic collar 12 is of ferromagnetic material (for example steel) having a high permeability compared to the Earth surrounding the borehole and the non-magnetic collar. There may, or may not, be other ferromagnetic materials contained in the drill assembly 15 below the non-magnetic collar. It is generally well known that the ferromagnetic materials above, and possibly below, the non-magnetic collar 12 cause anomalies in the Earth's magnetic field in the region of the survey tool that in turn cause errors in the measurement of the azimuthal direction of the survey tool.

It is further well know that such anomalies may include both fixed and induced error fields, the fixed error fields resulting from residual magnetic effects in the ferromagnetic materials and the induced error fields resulting from distortion of the Earth's true field by the high-permeability ferromagnetic materials. It is also well known from both theoretical considerations and experiment that the predominant error field lies along the direction of the drill string. It is this latter knowledge that the predominant error lies along the drill string direction that has led to all of the previously cited methods to eliminate such an error component. As previously stated, all such methods discard the measurement along the drill string axis and find either a two-component solution or a three-component solution in which the third component is computed mathematically. All of these previous methods, therefore, result in significant error when the borehole path approaches a near-horizontal, near East/West direction.

Figure 2B:
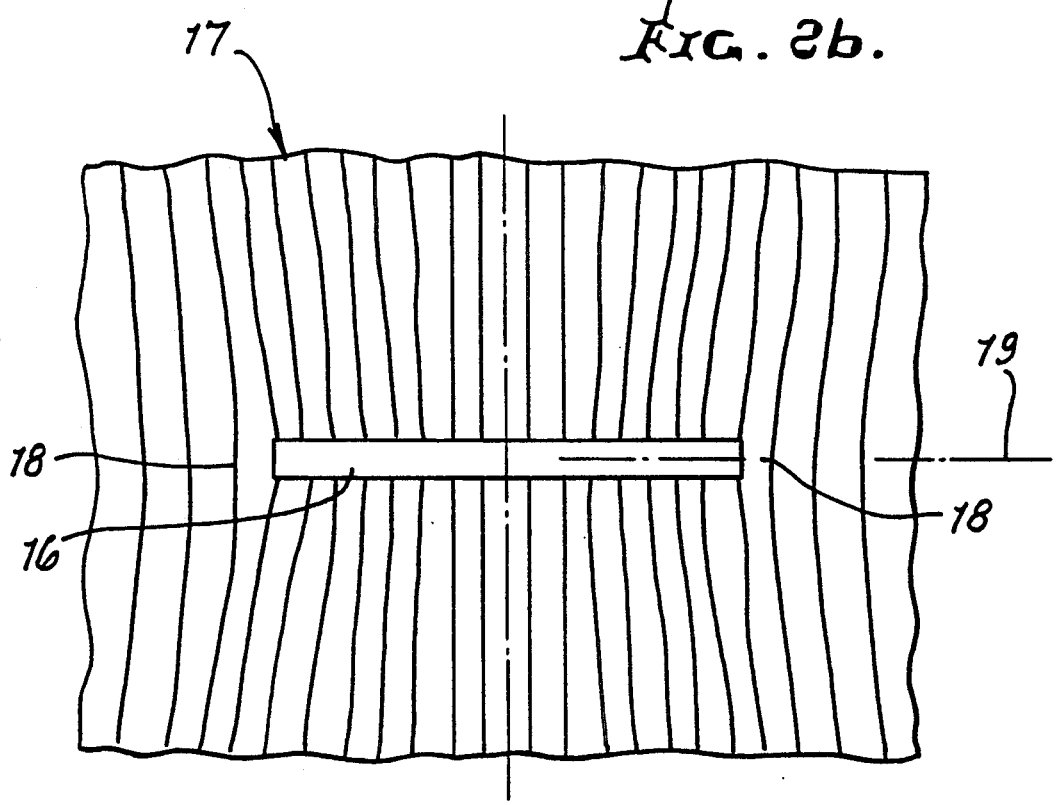

FIGS. 2*a* and 2*b* show the effects of a long piece of metal 16 of high permeability, immersed in an initially uniform magnetic field. The field lines 17 are distorted by the presence of the high permeability material. In FIG. 2*a*, the piece 16, generally tubular, is shown placed parallel to the original field, and in FIG. 2*b* perpendicular to the original field.

As can be seen from the figures, there is considerable increase in the density of field lines near the ends of piece 16, in regions 18, in FIG. 2*a* when the piece 16 is parallel to the original field. In FIG. 2*b*, when the piece 16 is perpendicular to the original field, there is only a small increase in the density of the field lines in the regions 18. Further, it can be noted that the field lines along the line of the axis 19, of piece 16, in regions 18, have the same direction as the original field lines. It may be verified either analytically or experimentally that for any arbitrary orientation of the piece 16 to the original field, the end result will be the superposition of the effects of the two components that may be resolved as along-axis and cross-axis to the piece.

A similar pattern to FIG. 2*a* (except that the field patterns close to loop from one end to the other) results if the piece 16 contains residual, permanent magnetic materials having poles lying along the axis 19. These patterns generally presented here are the basis for the previously cited correction algorithms used to avoid errors from magnetic effects in the drill string and bottom hole assembly. As previously cited, the assumption used is that the along-borehole error is the predominant error, and that by not using the measurement along the borehole axis, the error is avoided.

It may be shown either analytically or experimentally that the magnitude of the field anomalies shown in FIGS. 2*a* and 2*b* are linearly proportional to the original, undisturbed field as long as the permeability of the piece 16 is constant with field strength. Further, for the general case, the field along the axis 19 will be directly proportional to the cosine of the angle between the axis 19 and the total field vector of the original, undisturbed field.

FIGS. 3*a*, 3*b*, 3*c*, and 3*d* show an x, y, z coordinate set and the direction of a borehole axis 20, that is assumed to be colinear with the drill string 14 of FIG. 1. Defining the Earth's magnetic field as the vector H having components $H_x$, $H_y$, $H_z$, along the three axes of the survey tool 11, the measurements of the three magnetometers in the survey tool will be:

x-Magnetometer $H_x$ (1)

y-Magnetometer $H_y$ (2)

z-Magnetometer $H_z$ (3)

in the absence of any disturbances from magnetic materials in the drill string.

Similarly, defining the Earth's gravity as the vector G, the measurements of the three accelerometers in the survey tool will be:

x-Accelerometer $G_x$ (4)

y-Accelerometer $G_y$ (5)

z-Accelerometer $G_z$ (6)

In FIG. 3, starting with the three-axis, Earth-fixed coordinate set, N, E, D—(representing North, East, and Down) where the underline represents a unit vector in the direction given, the orientation of the set of tool axes x, y, z is defined by a series of rotation angles, AZ, TI, HS (representing AZimuth, TIlt, and HighSide). In this nomenclature, x is rotated by HS from the vertical plane, y is normal to x, and z is down along the borehole axis. The formulation of the calculation of azimuth, adapted from U.S. Pat. No. 3,862,499, is:

$$AZ = \text{Arctan}\frac{-(H_x{*}\text{Sin}(HS) + H_y{*}\text{Cos}(HS))}{\text{Cos}(TI){*}(H_x{*}\text{Cos}(HS) - H_y{*}\text{Sin}(HS)) + H_z{*}\text{Sin}(TI)} \quad (7)$$

In this equation, $H_x$, $H_y$, and $H_z$ are the three magnetometer-measured components. The angles TI and HS are solved for from the three accelerometer-measured components by well known methods in previous steps.

If there are induced field and permanent field effects from materials in the drill string, defined as $H_I$ and $H_F$, respectively, and the symmetries are as discussed in FIG. 2 above, then the x- and y-magnetometer measurements will remain as above, but the z-magnetometer measure will become:

$$\text{z-Magnetometer } H_z+H_I+H_F \tag{8}$$

However, the induced field, $H_I$, was previously stated to be proportional to the original field along the axis of the magnetic material and, therefore, it must be proportional to $H_z$. If one describes the proportionality by a constant, $K_I$, then:

$$H_I=K_I*H_z \tag{9}$$

and the z-magnetometer measurement then becomes:

$$\text{z-Magnetometer } (1+K_I)*H_z+H_F \tag{10}$$

This shows that the output of the z-magnetometer measurement may be interpreted Just like the other two measurements, but that the scale factor of the measurement is now $(1+K_I)$; and there is an offset or bias-type of error, $H_F$, added to the measurement. If the values of $K_I$ and $H_F$ could be determined, then the z-magnetometer output could be used in azimuth computation without error and the magnetic influence of the drill string could be avoided without encountering the problem of increasing error as the high tilt, East/West condition is approached.

There is no way that the two unknowns, $K_I$ and $H_F$, can be determined from a single set of measurements at one survey station. However, from a series of two or more measurements at different locations along the borehole where the z-axis components of the Earth's field, $H_z$, are different, a solution for the two unknowns may be found. A series of measurements may be expressed as:

$$\begin{aligned} H_{zm}(1) &= H_z(1)*(1+K_I)+H_F \\ H_{zm}(2) &= H_z(2)*(1+K_I)+H_F \\ H_{zm}(3) &= H_z(3)*(1+K_I)+H_F \\ H_{zm}(4) &= H_z(4)*(1+K_I)+H_F \\ H_{zm}(5) &= H_z(5)*(1+K_I)+H_F \\ &\vdots \\ H_{zm}(n) &= H_z(n)*(1+K_I)+H_F \end{aligned} \tag{11}$$

where $H_{zm}(n)$ represents the n-th measurement at the n-th location along the borehole of the z-axis magnetic field component and $H_z(n)$ represents the corresponding n-th true z-axis component of the Earth's true field, not including the anomalies resulting from magnetic materials in the drill string or other bottom hole assembly components.

The previously cited methods for correction of magnetic errors do not use the z-axis measurement. They do, however, either compute a z-axis component or compute an azimuth without such a component (from which a z-axis component may be computed). Since, except for regions near high inclination East/West, the azimuth results have been shown to produce reasonably accurate results, it follows that such computed z-axis components are much more accurate than measured z-axis components. Thus, in the above series of measurements $H_{zm}(n)$, if the corresponding $H_z(n)$ values are computed by any of the cited methods, the set of measurement equations may be solved for the two unknowns, $K_I$ and $H_F$.

Since there are two unknowns, a minimum of two measurements (to provide two equations) is required. For example:

$$H_{zm}(1)=H_z(1)*(1+K_I)+H_F \tag{12}$$

$$H_{zm}(2)=H_z(2)*(1+K_I)+H_F \tag{13}$$

may be solved to obtain:

$$K_I=\frac{(H_{zm}(1)-H_{zm}(2))}{(H_z(1)-H_z(2))}-1 \tag{14}$$

$$H_F=\frac{H_z(1)*H_{zm}(2)-H_z(2)*H_{zm}(1)}{H_z(1)-H_z(2)} \tag{15}$$

In general, if there are more measurements than there are unknowns, the system of measurement equations is said to be overdetermined. However, considering various errors that may be involved in the measurement or computation processed, it is still desirable to use as much measurement data as possible to minimize errors in the unknowns' values sought. This is the classical problem of parameter estimation that has been addressed in many fields. One well-known method leading to what is known as a "least-squared-error result" is shown below.

The set of measurements $H_{zm}(1)$—$H_{zm}(n)$ can be represented as the n-element vector $\underline{H}_{zm}$, called "the measurement vector", where the vector notation is indicated by the underscore.

The unknown quantities $(1+K_I)$ and $H_F$ may be represented as a 2-element vector $\underline{x}$. These vectors may be related by writing:

$$\underline{H}_{zm}=H\underline{x}+v \tag{16}$$

where H, a matrix called the measurement matrix, is an $n\times 2$ matrix:

$$H=\begin{bmatrix} H_z(1) & 1 \\ H_z(2) & 1 \\ H_z(3) & 1 \\ H_z(4) & 1 \\ \vdots & \\ H_z(n) & 1 \end{bmatrix} \tag{17}$$

and where $\underline{x}$ is the unknown vector:

$$x=\begin{bmatrix} K_I \\ H_F \end{bmatrix} \tag{18}$$

and $\underline{v}$ is a vector of measurement "noise". The solution desired is that for the "best" estimate of $\underline{x}$, minimizing the effects of the measurement "noise". When the "best" criteria is defined as that solution, that minimizes the sum of the squares of the elements of $\underline{H}_{zm}-H\hat{\underline{X}}$, where the symbol ^ over $\underline{x}$ indicates the best estimate of $\underline{x}$, then it may be shown that $$\hat{\underline{x}}=(H^TH)^{-1}H^T\underline{H}_{zm} \tag{19}$$

where $H^T$ is the transpose of the n×2 matrix H and $(H^TH)^{-1}$ is the matrix inverse of the matrix $H^TH$.

The method shown above, as represented by equations (11) through (19), will result in some error in the determination of the desired unknown $K_I$ and $H_F$ that depends on errors in the reference values of the Earth's magnetic field, since errors in these quantities will produce some error in the computed "true" values of $H_z(n)$. Such reference-induced errors are the accuracy limiting factors in the correction algorithms of the previously cited patents.

A method that does not depend on Earth's field reference may be found by generalizing the problem. In general, a series of measurements of some quantity, for example z, can be represented as the value, for example x, plus some unknown measurement error, for example v. The series of measurements may be written in vector/matrix notation as:

$$\underline{z}=H\underline{x}+\underline{v} \tag{20}$$

where:

$$\underline{z}=\begin{bmatrix} z1 \\ z2 \\ z3 \\ . \\ . \\ . \\ zn \end{bmatrix} \text{ an } n\text{-element measurement vector} \tag{21}$$

$$\underline{x}=\begin{bmatrix} x1 \\ . \\ . \\ . \\ xm \end{bmatrix} \text{ an } m\text{-element unknown vector} \tag{22}$$

H is an n- by m-element measurement matrix (23)

$$\underline{v}=\begin{bmatrix} v1 \\ v2 \\ v3 \\ . \\ . \\ . \\ vn \end{bmatrix} \text{ an } n\text{-element measurement error vector} \tag{24}$$

Given these definitions, consider an unknown vector $\underline{x}$ defined as:

$$\underline{x}=\begin{bmatrix} H_{Total} \\ H_{Vertical} \\ H_{North} \\ K_I \\ H_F \end{bmatrix} \tag{25}$$

where, in addition to the previously defined $K_I$ and $H_F$:

$H_{Total}$ is the total Earth field magnitude at the borehole location.

$H_{Vertical}$ is the vertical component of the total Earth field.

$H_{North}$ is the horizontal North component of the field.

Here the Earth-field quantities are added to the unknown vector and will be estimated, along with the z-axis magnetometer scale factor and bias, $K_I$ and $H_F$.

A new measurement vector $\underline{z}$ and a new measurement matrix H are required for this expanded problem. Also, since there are more unknowns, more equations and more survey locations will be required.

Define the two vectors of unit length, $\underline{p}$ and $\underline{q}$ as:

$$p=\frac{H}{(H_x^{\wedge 2}+H_y^{\wedge 2}+H_z^{\wedge 2})^{\frac{1}{2}}} \tag{26}$$

$$q=\frac{G}{(G_x^{\wedge 2}+G_y^{\wedge 2}+G_z^{\wedge 2})^{\frac{1}{2}}} \tag{27}$$

That is, the vector $\underline{p}$ is a unit vector in the same direction as the Earth's magnetic field vector $\underline{H}$, as measured by the magnetometers; and $\underline{q}$ is a unit vector in the same direction as the Earth's gravity field $\underline{G}$, as measured by the accelerometers. The vector $\underline{q}$ is thus along the direction D (Down) in FIG. 3*a*.

Now define a unit vector $\underline{r}$ as:

$$r=\frac{\underline{q}\times\underline{p}}{|\underline{q}\times\underline{p}|} \tag{28}$$

That is, the vector $\underline{r}$ is a vector that is the vector cross product of the vectors $\underline{p}$ and $\underline{q}$ divided by the absolute magnitude of the same vector cross product. Thus, r is a unit vector; and, since, by definition, the vectors H and G and thereby the vectors p and q lie in the North-South plane of FIG. 3*a*, the vector $\underline{r}$ is in the E (East) direction of FIG. 3.

Lastly, define a vector $\underline{s}$ as:

$$\underline{s}=\underline{r}\times\underline{q} \tag{29}$$

Figure 3A:
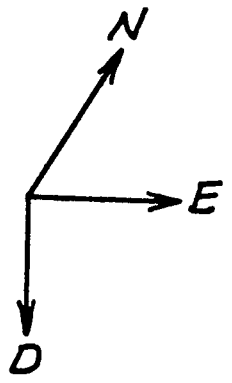
Figure 3B:
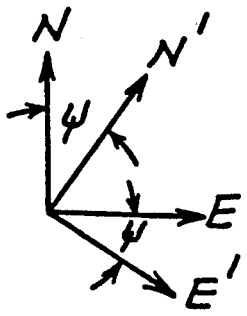
Figure 3C:
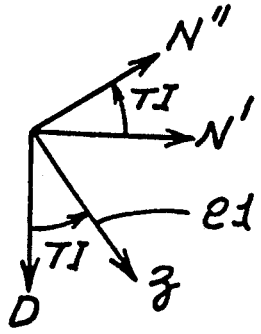
Figure 3D:
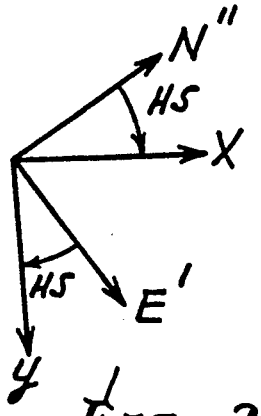

That is, the vector $\underline{s}$ is the vector cross product of the vectors $\underline{r}$ and $\underline{q}$, and is thus a unit vector in the N (North) direction in FIG. 3*a*.

Each of the three vectors, $\underline{p}$, $\underline{q}$, and $\underline{s}$, has three components—one component along the x-axis, one component along the y-axis, and one component along the z-axis. The three components for the vector $\underline{p}$ are defined as $p_x$, $p_y$, and $p_z$. The three components for the vector $\underline{q}$ are defined as $q_x$, $q_y$, and $q_z$. The three components for the vector $\underline{s}$ are defined as $s_x$, $s_y$, and $s_z$.

With these three unit vector definitions for $\underline{p}$, $\underline{q}$, and $\underline{s}$, these three vectors may be computed at each survey location from the measured $\underline{H}$ and $\underline{G}$ vectors. Then, three elements of the total measurement vector $\underline{z}$ may be computed for each survey location. For example, consider the three elements of the vector $\underline{z}$ for the first location, which are to be computed as:

$$z(1)=\underline{H}_m \cdot \underline{p}$$

$$z(2)=\underline{H}_m \cdot \underline{q}$$

$$z(3)=\underline{H}_m \cdot \underline{s} \tag{30}$$

That is, each of these three elements is just the vector dot product of the measured magnetic field vector $\underline{H}_m$ and the $\underline{p}$, $\underline{q}$, and $\underline{s}$ vectors defined and computed, as shown in equations (26) through (29). z(1) is thus a measure of the total magnetic field; z(2) is a measure of the vertical component of that field; and z(3) is a measure of the horizontal North component of that total field.

Also, for each survey station, three rows of the measurement matrix H that relates the measurement vector $\underline{z}$ to the unknown vector $\underline{x}$ may be computed in terms of the measured magnetic field components and the elements of the vectors $\underline{p}$, $\underline{q}$, and $\underline{s}$. These three rows, for the unknown vector $\underline{x}$, as defined by equation (25) are:

| | | | | | |
|---|---|---|---|---|---|
| 1 | 0 | 0 | $p_z*H_z$ | $p_z$ | |
| 0 | 1 | 0 | $q_z*H_z$ | $q_z$ | (31) |
| 0 | 0 | 1 | $s_z*H_z$ | $s_z$ | |

Since there are five unknown quantities in the unknown vector $\underline{x}$, the quantities shown in equations (30) and (31) are not sufficient to solve for the unknown vector $\underline{x}$ by using equation (19). A minimum of three survey locations is recommended. More locations will increase the accuracy of the determination of the unknown vector $\underline{x}$.

As previously stated, three elements of the measurement vector $\underline{z}$ are computed as in equation (30); and three rows of the measurement matrix H are computed as in equation (31) for each survey location. If the recommended minimum of three survey locations is used, the measurement vector $\underline{z}$ becomes a nine element vector, and the measurement matrix H becomes a nine row by five column matrix. If six survey locations were used, the measurement vector would have eighteen elements, and the measurement matrix would have eighteen rows and still five columns.

When sufficient survey locations have been accumulated, then the unknown vector $\underline{x}$ is solved for using equation (19) with the measurement vector $\underline{z}$ substituted for $\underline{H}_{zm}$. This then provides results that indicate $H_{Total}$, the total magnetic field; $H_{Vertical}$, the vertical component; $H_{North}$, the horizontal component; $K_I$, the desired anomalous scale factor caused by the induced magnetization from drill string elements; and $H_F$, the desired anomalous bias or offset resulting from the fixed magnetization in the drill string elements.

The values—$H_{Total}$, $H_{Vertical}$, and $H_{North}$—may be used for quality control purposes, or as input reference data to any of the previously cited patent methods of interference compensation that require input data on the local Earth magnetic field. For quality control purposes, these values may be compared to reference values obtained from maps or Earth-field computer models. If the values depart significantly from the reference values, it indicates either a possible failure in the sensors in the survey tool or a significant geophysical local variation in the Earth's field. Either one of these possibilities alerts the survey operator to possible serious survey error.

The values of $K_I$ and $H_F$ may be used to compute corrected values of the z-axis magnetometer measure of the Earth field for each survey location as:

$$H_{zc}(n) = \frac{(H_{zm}(n) - H_F)}{1 + K_I} \tag{32}$$

where:

$H_{zc}(n)$ is the corrected z-axis value for location n $H_{zm}(n)$ is the measured z-axis value for location n This corrected value for location n may then be combined with the measured x-axis and y-axis measured magnetic components to solve for the borehole azimuth at location n, as shown in equation (7).

Some care is needed in selection of the locations that are to be used in the solution for the model unknowns. As is well known, if the borehole path is a straight line, all of the measurement equations are highly correlated, and there will be no viable solution for the unknowns. In effect, all of the equations are equivalent and, therefore, the requirement that the number of equations must equal or exceed the number of unknowns is not met. In general, the methods of selecting the equations for solution of simultaneous equations are well known; and methods are known for the analysis of probable errors in the solution for unknowns from multiple equations.

Further, in the implementation of the methods described here, it may be found that some measurements or estimates of the along-borehole magnetic field are more accurate than others in the series of locations to be used for solving for the unknowns. In this event, the well-known methods of "weighted" solution for unknowns may be used wherein the more accurate data is "weighted" more heavily in the solution to minimize errors.

The vector $\underline{v}$ of measurement errors, defined at equation (24), may be further characterized in general by a matrix computed from its elements that is usually designated as the covariance matrix of the error vector and is often designated by the letter R. This matrix is computed as the expected value of the matrix product of the vector v and its transpose. Thus:

$$R=E(\underline{v}*\underline{v}^T) \tag{33}$$

where:

E designates the expected value of the product

Superscript T denotes the transpose.

With this definition and the terms defined above, it may be shown that the optimum estimate of the unknown elements in the vector x that minimizes the sum of the squared errors in the estimate is given by:

$$\hat{\underline{x}}=(H^T*R^{-1}*H)^{-1}*(H^T*R^{-1})*\underline{z} \tag{34}$$

where:

* denotes matrix product

Superscript T is transpose

Superscript −1 denotes matrix inverse

The actual values of the elements of the measurement noise vector $\underline{v}$ are not known. If they were known, the values could be subtracted from the elements of the measurement vector and the problem could then be solved with errorless measurement data. However, the expected statistical value of the elements of $\underline{v}$ can be computed by error analysis of the elements of the measurement vector. Such errors will, in general, depend on the errors in all of the sensors and on the orientation of the borehole with respect to the Earth coordinate set. When these expected values have been determined, the covariance matrix R can be determined using equation (33); and then the unknown vector $\underline{x}$ may be determined using equation (34).

Both equations (19) and (34) are well known means to obtain so-called "least squared error" estimates of unknowns from an overdetermined set of equations. They require computer storage and manipulation of all of the data included in the solution. Recursive "least squared error" formulations that work incrementally on the data, for example as each new survey location data becomes available, rather than waiting for the complete data set from all locations to be used, are well known. One of the better known such recursive methods is the method called "Kalman filtering", after its developer Dr. R. E. Kalman. This method is described in Chapter 4 of the book *Applied Optimal Estimation,* Arthur Gelb et al., The M.I.T. Press, Cambridge, Mass. In this method, the input sensor data is processed as it is received and a continuing estimate of the unknown vector and its covariance matrix is computed. The recursive formulation eliminates the need to provide ever increasing storage and to process matrix computations of ever growing matrix dimensions as larger numbers of data sets (survey locations) are added to the computation. This mechanization is a real time formulation that at each cycle (each new survey location) provides an optimal estimate of the unknowns.

Additionally, it may be desirable to use more complex models for the magnetic interference. For example, the equivalent scale factor anomaly may require non-linear terms or temperature dependent terms to achieve higher accuracies under some conditions. Also, the unknown vector may be expanded to include anomalous scale factor and bias terms for the cross-borehole magnetometers. This would account for cases in which the drill string magnetic interference was not principally along the axial direction as originally assumed. As the unknown vector is expanded, the measurement matrix must be expanded so that the number of columns in it is equal to the number of elements in the unknown vector. The general method above may still be used, but it must be recognized that more unknowns lead to a need for more independent measurement equations from which elements of the measurement vector are to be computed.

Another solution to the problem of obtaining the best results from a series of multiple measurements is that known as "Optimal Linear Smoothing", as described in Chapter 5 of the book *Applied Optimal Estimation,* Arthur Gelb et al., The M.I.T. Press, Cambridge, Mass. In this formulation, all of the measurement data is combined to provide an optimal estimate of all elements of the state vector describing the physical process at each point within the series of measurements. Smoothing, as defined in the cited reference, is a non-real-time data processing scheme that uses all measurements. The general methodology is generally related to the well-known Kalman filtering methods. In optimal smoothing, in effect, Kalman filtering is applied to the data set both from the first data point forward in time to the location of interest; and from the last data point backwards in time to the same location of interest.

In its simplest form then, the essential elements of the invention described herein are:

1) Select a model for the magnetic interference effects of the drill string and other bottom hole assembly components on the z-axis magnetometer measurements.

2) Make a series of 3-axis measurements of the total magnetic field at different locations along the borehole path.

3) Compute, by any of a variety to known methods, an estimate of the true Earth's magnetic field along the borehole axis at each of the different locations.

4) Using the model selected and the series of borehole axis measurements and estimates, solve for the coefficients of the model.

5) Correct the z-axis magnetometer data using the coefficients determined in step 4) above for each survey location.

6) Solve for the azimuthal orientation of the borehole at each location using the corrected magnetometer data for each survey location.

In more generalized method, the essential elements of the invention are:

1) Select a model for the magnetic interference effects of the drill string and other bottom hole assembly components on the magnetometer measurements and define an unknown vector that contains the elements of the selected model.

2) Make a series of 3-axis measurements of the total magnetic field at different locations along the borehole path.

3) Compute for the series of different locations a measurement vector and a measurement matrix relating the measurement vector to the unknown vector.

4) Using the measurement vector and the measurement matrix, solve for the unknown vector to determine the elements of the selected model.

5) Correct the magnetometer data using the coefficients determined in step 4) above for each survey location.

6) Solve for the azimuthal orientation of the borehole at each location using the corrected magnetometer data for each survey location.

I claim:

1. A method for determining the orientation of the axis of a borehole with respect to an Earth-fixed reference coordinate system at a selected series of locations in the borehole, the borehole having a trajectory, and adapted to receive a drill string, comprising the steps of:

a) defining a model for the influence of magnetic interference from elements of the drill string on the measurement of components of the Earth's magnetic field in the borehole in terms of an unknown vector, a measurement vector, and a measurement matrix relating the unknown vector and the measurement vector, b) measuring at two or more selected locations along the borehole trajectory:

1) at least one of:

i) two cross-borehole components of the Earth's gravity field at said selected locations in the borehole, and ii) two cross-borehole components and an along-borehole component of the Earth's gravity field at said selected locations in the borehole;

2) two cross-borehole components of the Earth's magnetic field and an along-borehole component of the Earth's magnetic field at said selected locations;

c) computing the elements of said measurement vector and said measurement matrix from said measured Earth's gravity and Earth's magnetic field components for said selected locations;

d) solving for said unknown vector using said measurement vector and said measurement matrix, e) computing for each of said selected locations corrected values for the Earth's magnetic field components using said unknown vector, said model, and said measured Earth's magnetic field components, f) and determining a value for the azimuthal orientation of said borehole axis at each said selected locations using said corrected values for the Earth's magnetic field components and said measured gravity components.

2. The method of claim 1 wherein said model and said unknown vector include:

a) an anomalous scale factor value for said along-borehole measurement of the Earth's magnetic field component in the along-borehole direction, b) an anomalous bias or offset value for said along-borehole measurement of the Earth's magnetic field component in the along-borehole direction.

3. The method of claim 1 wherein said model and said unknown vector include the magnitude of the Earth's total magnetic field, excluding said effects of said drill string magnetic interference.

4. The method of claim 1 wherein said model and said unknown vector include the magnitude of the vertical component of the Earth's total magnetic field, excluding said effects of said drill string magnetic interference.

5. The method of claim 1 wherein said model and said unknown vector include the magnitude of the horizontal component of the Earth's total magnetic field, excluding said effects of said drill string magnetic interference.

6. The method of claim 1 wherein said measurement vector comprises the differences between said measured along-borehole magnetic field components and estimates of the true value of the along-borehole magnetic field components at said selected locations.

7. The method of claim 1 wherein said measurement vector includes the computed total values of the measured Earth's magnetic field at said selected locations.

8. The method of claim 1 wherein said measurement vector includes the computed vertical component values of the measured Earth's magnetic field at said selected locations.

9. The method of claim 1 wherein said measurement vector includes the computed horizontal component values of the measured Earth's magnetic field at said selected locations.

10. The method of claim 1 wherein the unknown vector is solved for by employing multiple simultaneous equations relating the measurement vector to the unknown vector.

11. The method of claim 1 wherein the unknown vector is solved for by employing a "least squared error" computation using said measurement vector and said measurement matrix relating said measurement vector to said unknown vector.

12. The method of claim 1 wherein the unknown vector is solved for by employing a "weighted least squared error" computation using said measurement vector, said measurement matrix relating said measurement vector to said unknown vector and the covariance matrix of said measurement vector.

13. The method of claim 1 wherein the unknown vector is solved for by employing a Kalman filtering computation using said model, said unknown vector, said measurement vector, and said measurement matrix.

14. The method of claim 1 wherein the unknown vector is solved for by employing an "optimal linear smoothing" computation using said model, said unknown vector, said measurement vector, and said measurement matrix.

15. The method of claim 1 wherein said model includes a fixed field component resulting from permanently magnetized elements in at least one of the following:

i) the drill string, which is metallic, ii) a bottom hole metallic assembly in the borehole.

16. The method of claim 1 wherein said model includes an induced field component resulting from the interaction of soft magnetic materials in the borehole with the Earth's magnetic field.

17. The method of claim 1 wherein the borehole trajectory has a portion that extends in a near horizontal, East-West direction.

18. The method of claim 1 including a survey tool for performing said method, and including locating said tool in said portion of said borehole.

19. The method of determining the orientation of the axis of a borehole in the Earth, that includes a) determining a set of along-axis magnetometer errors at different points along the borehole, b) determining a model composed of a fixed magnetic component and an induced magnetic component, associated with magnetization in the borehole, c) and fitting said errors to said model for determining bias and scale factors, d) whereby accurate, along-axis measurements can be computed using the determined bias and scale factor values.

20. The method of claim i including employing magnetometers to effect said b) 2) step measuring, wherein said along-borehole component is represented by:

$$(1+K_I)*H_z+H_F$$

wherein the quantity $(1+K_I)$ is the scale factor of the measurement and the quantity $H_F$ is a bias type of correction, and said method steps, including said measurements at said two or more locations, derive values for $(1+K_I)$ and $H_F$.

21. The method of claim 20 wherein a corrected value $H_{zc}(n)$ for a Z-axis magnetometer is obtained for each survey location, according to:

$$H_{zc(n)} = \frac{(H_{zm(n)} - H_F)}{1 + K_I}$$

where $H_{zm}(n)$ is the measured z-axis value for location n.

22. The method of claim 21 wherein borehole azimuth AZ then obtained according to:

$$AZ = \text{Arctan}\frac{-(H_x*\text{Sin}(HS) + H_y*\text{Cos}(HS))}{\text{Cos}(TI)*(H_x*\text{Cos}(HS) - H_y*\text{Sin}(HS)) + H_z*\text{Sin}(TI)}.$$

* * * * *